US009335777B2

(12) United States Patent
Shin

(10) Patent No.: US 9,335,777 B2
(45) Date of Patent: May 10, 2016

(54) VOLTAGE GENERATION CIRCUITS AND SEMICONDUCTOR DEVICES INCLUDING THE SAME

(71) Applicant: Sk hynix Inc., Icheon-si Gyeonggi-do (KR)

(72) Inventor: Jin Wook Shin, Icheon-si (KR)

(73) Assignee: SK hynix Inc., Icheon-si Gyeonggi-do (KR)

( * ) Notice: Subject to any disclaimer, the term of this patent is extended or adjusted under 35 U.S.C. 154(b) by 136 days.

(21) Appl. No.: 14/284,091

(22) Filed: May 21, 2014

(65) Prior Publication Data

US 2015/0177769 A1 Jun. 25, 2015

(30) Foreign Application Priority Data

Dec. 19, 2013 (KR) ..... 10-2013-0159076

(51) Int. Cl.
*G05F 1/10* (2006.01)
*G05F 3/16* (2006.01)
*G05F 3/26* (2006.01)

(52) U.S. Cl.
CPC . *G05F 3/16* (2013.01); *G05F 3/262* (2013.01)

(58) Field of Classification Search
CPC ..... G05F 3/262; G05F 3/30; G05F 3/02; G05F 1/465
USPC ..... 327/538, 539, 540, 541, 542, 543; 323/312–317
See application file for complete search history.

(56) References Cited

U.S. PATENT DOCUMENTS 6,642,774 B1 * 11/2003 Li ..... H02M 3/073 327/536
2001/0022522 A1 * 9/2001 Shim ..... G11C 7/1072 327/155
2006/0261881 A1 * 11/2006 Chang ..... H02M 3/073 327/538
2008/0297132 A1 * 12/2008 Aota ..... H02M 3/1588 323/313
2012/0249187 A1 10/2012 Kumazaki

FOREIGN PATENT DOCUMENTS

KR 1020060132845 A 12/2006

* cited by examiner

*Primary Examiner* — Nguyen Tran
(74) *Attorney, Agent, or Firm* — William Park & Associates Ltd.

(57) ABSTRACT

Voltage generation circuits are provided. The voltage generation circuit includes a reference voltage generator suitable for generating a reference voltage signal having a constant level without a correspondence to a temperature variation. A comparator suitable for comparing a first drivability controlled by a level of the reference voltage signal with a second drivability controlled by a level of a comparison voltage signal to generate a comparison signal. A voltage controller may be configured to generate the comparison voltage signal whose level continuously increases until the comparison signal is enabled.

11 Claims, 6 Drawing Sheets

FIG. 4

| COMBINATION OF FIRST AND SECOND COUNT SIGNALS | CNT<2> | CNT<1> | DIVISION VOLTAGE SIGNAL OUTPUTTED AS COMPARISON VOLTAGE SIGNAL |
|---|---|---|---|
| FIRST COMBINATION | L | L | DIV1 |
| SECOND COMBINATION | L | H | DIV2 |
| THIRD COMBINATION | H | L | DIV3 |
| FOURTH COMBINATION | H | H | DIV4 |

VOLTAGE GENERATION CIRCUITS AND SEMICONDUCTOR DEVICES INCLUDING THE SAME

CROSS-REFERENCE TO RELATED APPLICATION

The present application claims priority under 35 U.S.C 119(a) to Korean Application No. 10-2013-0159076, filed on Dec. 19, 2013, in the Korean Intellectual Property Office, which is incorporated herein by reference in its entirety as set forth in full.

BACKGROUND

1. Technical Field

Embodiments of the invention relate to semiconductor integrated circuits and, more particularly, to voltage generation circuits and semiconductor devices including the same.

2. Related Art

A semiconductor device receives a power supply voltage VDD and a ground voltage VSS supplied from an external device to generate internal voltages used in operation of internal circuits constituting the semiconductor device. The internal voltages for operating the internal circuits of the semiconductor device may include a core voltage VCORE applied to a memory core region, a high voltage VPP used to drive or overdrive word lines, and a back-bias voltage VBB applied to a bulk region (or a substrate) of NMOS transistors in the memory core region.

Further, the internal voltages for operating the internal circuits of the semiconductor device may include a cell plate voltage VCP applied to a plate node of cell capacitors in the memory core region and a bit line pre-charge voltage VBLP used to pre-charge bit lines. The cell plate voltage VCP and the bit line pre-charge voltage VBLP may be generated from the core voltage VCORE and may be generated to have a half level of the core voltage VCORE for minimization of power consumption.

SUMMARY

According to various embodiments, a voltage generation circuit includes a reference voltage generator suitable for generating a reference voltage signal having a constant level with no relation to a temperature variation. The voltage generation circuit may also include a comparator suitable for comparing a first drivability controlled by a level of the reference voltage signal with a second drivability controlled by a level of a comparison voltage signal to generate a comparison signal. The voltage generation circuit may also include voltage controller suitable for generating the comparison voltage signal whose level continuously increases until the comparison signal is enabled.

According an embodiment, a semiconductor device includes a voltage generation circuit suitable for comparing a first drivability controlled by a reference voltage signal with a second drivability controlled by a comparison voltage signal to generate a comparison signal. A level of the comparison voltage signal increases until the comparison signal is enabled. A semiconductor device also includes a voltage supply circuit suitable for outputting the comparison voltage signal as an internal voltage signal when the comparison signal is enabled. The semiconductor device may also include an internal circuit suitable for being driven by the internal voltage signal.

According to an embodiment, a semiconductor device includes a voltage generation circuit and an internal circuit. The voltage generation circuit is suitable for comparing a first drivability controlled by a reference voltage signal with a second drivability controlled by a comparison voltage signal to generate a comparison signal. The voltage generation circuit may also be configured to control a level of the comparison voltage signal until the comparison signal is enabled. In addition, the voltage generation circuit may also be configured to output the comparison voltage signal as an internal voltage signal when the comparison signal is enabled. The internal circuit is suitable for being driven by the internal voltage signal.

BRIEF DESCRIPTION OF THE DRAWINGS

FIG. 4 is a table illustrating an operation of a selection transmitter included in the voltage controller of FIG. 3;

DETAILED DESCRIPTION

Figure 1:
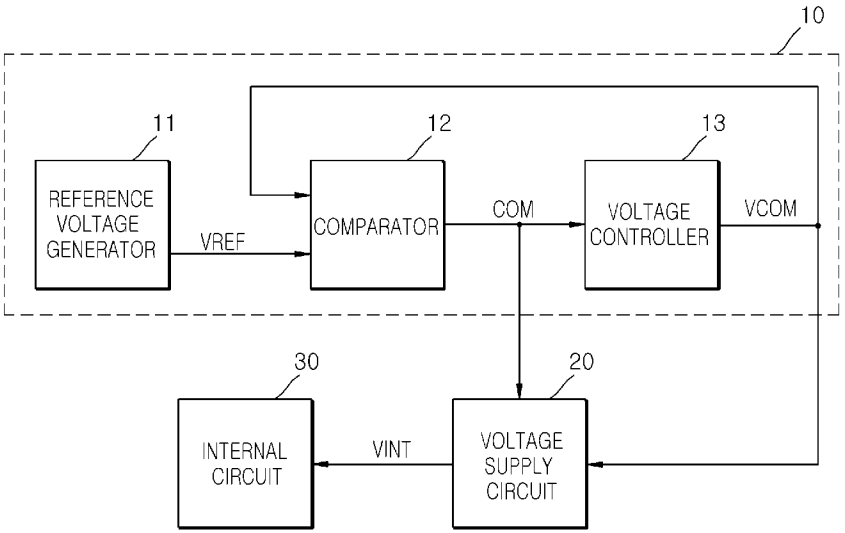
FIG. 1 is a block diagram illustrating a semiconductor device according to an embodiment of the invention.

Various embodiments of the will be described more fully hereinafter with reference to the accompanying drawings. However, the embodiments described herein are for illustrative purposes only and are not intended to limit the scope of the invention. Transistors constituting the semiconductor device may be driven by the internal voltages generated in the semiconductor device. The drivability of the transistors may vary according to temperature. If the drivability of the transistors changes according to the temperature, operation currents of the transistors may also vary to cause malfunction of the semiconductor device Referring to FIG. 1, a semiconductor device according to an embodiment may include a voltage generation circuit 10, a voltage supply circuit 20 and an internal circuit 30.

The voltage generation circuit 10 may include a reference voltage generator 11, a comparator 12 and a voltage controller 13.

The reference voltage generator 11 may generate a reference voltage signal VREF having a constant level regardless of temperature variation. The reference voltage generator 11 may be realized using a circuit generating a constant voltage level regardless of variations of process/voltage/temperature (PVT) conditions. More specifically, the reference voltage generator 11 may be realized using a band gap voltage generation circuit or a Widlar voltage generation circuit.

The comparator 12 may compare a first drivability with a second drivability to generate a comparison signal COM enabled when the second drivability is greater than the first drivability. The first drivability may be controlled according to a level of the reference voltage signal VREF. The second drivability may be controlled according to a level of a comparison voltage signal VCOM.

The voltage controller 13 may generate the comparison voltage signal VCOM whose level continuously increases until the comparison signal COM is enabled. A level of the comparison voltage signal VCOM may vary according to a temperature.

The voltage supply circuit 20 may output the comparison voltage signal VCOM as an internal voltage signal VINT if the comparison signal COM is enabled. The voltage supply circuit 20 may control a level of the comparison voltage signal VCOM. The voltage supply circuit 20 may also output the controlled comparison voltage signal VCOM as the internal voltage signal VINT when the comparison signal COM is enabled.

The internal circuit 30 may be driven by the internal voltage signal VINT.

Figure 2:
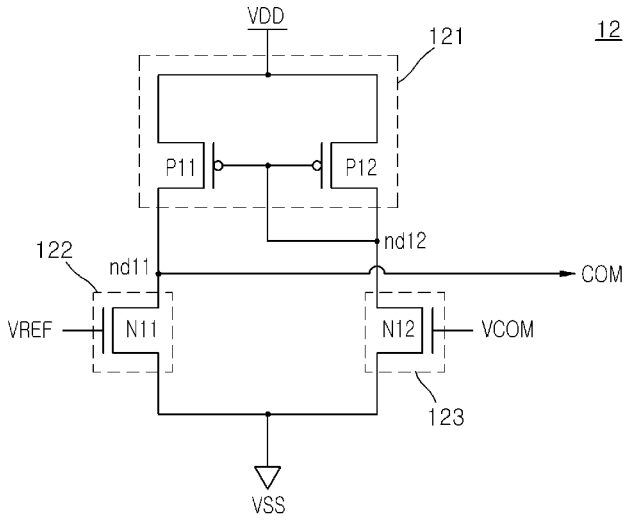
FIG. 2 is a circuit diagram illustrating a comparator included in a voltage generation circuit of the semiconductor device shown in FIG. 1.

Referring to FIG. 2, the comparator 12 may include a first driver 121, a second driver 122 and a third driver 123.

The first driver 121 may be configured to include a PMOS transistor P11 electrically coupled between a power supply voltage VDD terminal and a node ND11. The first driver 121 may also include a PMOS transistor P12 electrically coupled between the power supply voltage VDD terminal and a node ND12. The PMOS transistor P11 may drive the node ND11 according to a level of the node ND12. The PMOS transistor P12 may drive the node ND12 according to a level of the node ND12. Moreover, the first driver 121 may drive the nodes ND11 and ND12 to have the power supply voltage VDD according to a level of the node ND12.

The second driver 122 may be configured to include an NMOS transistor N11 coupled between the node ND11 and a ground voltage VSS terminal. The NMOS transistor N11 may drive the node ND11 to have the ground voltage VSS with the first drivability according to a level of the reference voltage signal VREF. More specifically, the second driver 122 may drive the node ND11 to the ground voltage VSS with the first drivability controlled according to a level of the reference voltage signal VREF. The first drivability may relate to the amount of current that flows from the node N11 toward the ground voltage VSS terminal through the NMOS transistor N11. The NMOS transistor N11 is turned on according to a level of the reference voltage signal VREF.

The third driver 123 may be configured to include an NMOS transistor N12 electrically coupled between the node ND12 and the ground voltage VSS terminal. The NMOS transistor N12 may drive the node ND12 to have the ground voltage VSS with the second drivability according to a level of the comparison voltage signal VCOM. More specifically, the third driver 123 may drive the node ND12 to the ground voltage VSS with the second drivability controlled according to a level of the comparison voltage signal VCOM. The second drivability may relate to the amount of current that flows from the node N12 toward the ground voltage VSS terminal through the NMOS transistor N12. The NMOS transistor N12 may be turned on according to a level of the comparison voltage signal VCOM.

The NMOS transistor N11 acting as a drive element of the second driver 122 may be designed to have a drive current greater than a drive current of the NMOS transistor N12. The NMOS transistor may be acting as a drive element of the third driver 123. In particular, the first drivability to drive the node ND11 to the ground voltage VSS may be greater than the second drivability to drive the node ND12 to the ground voltage VSS.

Figure 3:
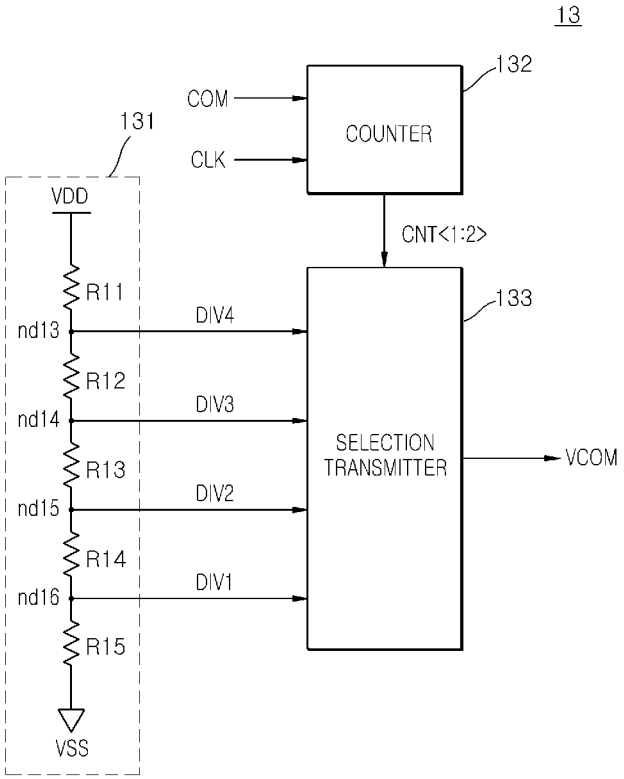
FIG. 3 is a block diagram illustrating a voltage controller included in a voltage generation circuit of the semiconductor device shown in FIG. 1.

Referring to FIG. 3, the voltage controller 13 may include a voltage divider 131, a counter 132 and a selection transmitter 133.

The voltage divider 131 may be configured to include a resistor R11 electrically coupled between the power supply voltage VDD terminal and a node ND13. The voltage divider 131 may also include a resistor R12 electrically coupled between the node ND13 and a node ND14. In addition, the voltage divider 131 may include a resistor R13 electrically coupled between the node ND14 and a node ND15. Further, the voltage divider 131 may also include a resistor R14 electrically coupled between the node ND15 and a node ND16. The voltage divider 131 may also include a resistor R15 coupled between the node ND16 and the ground voltage VSS terminal. More specifically, the voltage divider 131 may generate first to fourth division voltage signals DIV1~DIV4 whose levels are divided by the resistors R11, R12, R13, R14 and R15. The resistors R11 to R15 are serially electrically coupled between the power supply voltage VDD terminal and the ground voltage VSS terminal. The first division voltage signal DIV1 may be outputted through the node ND16. The second division voltage signal DIV2 may be outputted through the node ND15. Further, the third division voltage signal DIV3 may be outputted through the node ND14. In addition, the fourth division voltage signal DIV4 may be outputted through the node ND13. As a result, the second division voltage signal DIV2 may be generated to have a level higher than a level of the first division voltage signal DIV1. Moreover, the third division voltage signal DIV3 may be generated to have a level higher than a level of the second division voltage signal DIV2. Further, the fourth division voltage signal DIV4 may be generated to have a level higher than a level of the third division voltage signal DIV3. The levels of the first to fourth division voltage signals DIV1~DIV4 may vary according to resistance values of the resistors R11, R12, R13, R14 and R15.

The counter 132 may output first and second count signals CNT<1:2> counted in response to an external clock CLK if the comparison signal COM is disabled. More specifically, the counter 132 may output the first and second count signals CNT<1:2> counted in response to an external clock CLK until the comparison signal COM is enabled. The external clock CLK may be a signal that is periodically toggled. For example, the external clock CLK may be a signal including pulses which are periodically created.

The selection transmitter 133 may output any one of the first to fourth division voltage signals DIV1~DIV4 as the comparison voltage signal VCOM. The selection transmitter 133 may output any one of the first to fourth division voltage signals DIV1~DIV4 in response to a level combination of the first and second count signals CNT<1:2>.

An operation of the selection transmitter 133 will be described more fully hereinafter with reference to FIG. 4.

The first division voltage signal DIV1 may be outputted as the comparison voltage signal VCOM if the first count signal CNT<1> has a logic "low" level and the second count signal CNT<2> has a logic "low" level.

The second division voltage signal DIV2 may then be outputted as the comparison voltage signal VCOM if the first count signal CNT<1> has a logic "high" level and the second count signal CNT<2> has a logic "low" level.

Subsequently, the third division voltage signal DIV3 may be outputted as the comparison voltage signal VCOM if the first count signal CNT<1> has a logic "low" level and the second count signal CNT<2> has a logic "high" level.

Finally, the fourth division voltage signal DIV4 may be outputted as the comparison voltage signal VCOM if the first count signal CNT<1> has a logic "high" level and the second count signal CNT<2> has a logic "high" level.

An operation of the semiconductor device having the aforementioned configuration will be described hereinafter with reference to FIGS. 1, 2, 3 and 4. The operation of the semiconductor device will be described in conjunction with an example in which the second drivability is set to be greater than the first drivability. The second drivability is set to be greater than the first drivability to generate the internal voltage signal VINT when the second division voltage signal DIV2 is outputted as the comparison voltage signal VCOM according to a temperature variation.

The reference voltage generator 11 of the voltage generation circuit 10 may generate the reference voltage signal VREF having a constant level regardless of any temperature variation.

The first driver 121 of the comparator 12 may drive the nodes ND11 and ND12 to have the power supply voltage VDD according to a level of the node ND12. The second driver 122 may receive the reference voltage signal VREF to drive the node ND11 to the ground voltage VSS. The first drivability is greater than the second drivability. The third driver 123 may receive the comparison voltage signal VCOM to drive the node ND12 to the ground voltage VSS with the second drivability which is less than the first drivability. In particular, the comparator 12 may generate the comparison signal COM having a logic "low" level because the first drivability is greater than the second drivability.

The voltage divider 131 may divide the power supply voltage VDD to generate the first to fourth division voltage signals DIV1~DIV4. The counter 132 may receive the comparison signal COM having a logic "low" level to generate the first count signal CNT<1> having a logic "low" level. The counter 132 may also generate the second count signal <2> having a logic "low" level. The counter 132 may generate the first count signal CNT<1> and the second count signal <2> when a pulse of the external clock signal CLK is inputted thereto. The selection transmitter 133 may receive the first count signal CNT<1> having a logic "low" level and the second count signal <2> having a logic "low" level to output the first division voltage signal DIV1 as the comparison voltage signal VCOM.

The voltage supply circuit 20 may receive the comparison signal COM having a logic "low" level to not output the comparison voltage signal VCOM as the internal voltage signal VINT.

The reference voltage generator 11 of the voltage generation circuit 10 may then generate the reference voltage signal VREF having a constant level regardless of any temperature variation.

The first driver 121 of the comparator 12 may drive the nodes ND11 and ND12 to have the power supply voltage VDD according to a level of the node ND12. The second driver 122 may receive the reference voltage signal VREF to drive the node ND11 to the ground voltage VSS. The first drivability may be greater than the second drivability. The third driver 123 may receive the comparison voltage signal VCOM to drive the node ND12 to the ground voltage VSS. The second drivability may be less than the first drivability. More specifically, the comparator 12 may generate the comparison signal COM having a logic "low" level because the first drivability is greater than the second drivability.

The voltage divider 131 may divide the power supply voltage VDD to generate the first to fourth division voltage signals DIV1~DIV4. The counter 132 may receive the comparison signal COM having a logic "low" level to generate the first count signal CNT<1> having a logic "high" level. The counter 132 may also generate the second count signal <2> having a logic "low" level. In addition, the counter 132 may generate the first count signal CNT<1> and the second count signal <2> when a pulse of the external clock signal CLK is inputted thereto. The selection transmitter 133 may receive the first count signal CNT<1> having a logic "high" level and the second count signal <2> having a logic "low" level to output the second division voltage signal DIV2 as the comparison voltage signal VCOM.

The voltage supply circuit 20 may receive the comparison signal COM having a logic "low" level to not output the comparison voltage signal VCOM as the internal voltage signal VINT.

The reference voltage generator 11 of the voltage generation circuit 10 may generate the reference voltage signal VREF having a constant level regardless of any temperature variation.

The first driver 121 of the comparator 12 may drive the nodes ND11 and ND12 to have the power supply voltage VDD according to a level of the node ND12. The second driver 122 may receive the reference voltage signal VREF to drive the node ND11 to the ground voltage VSS. The first drivability may be less than the second drivability. The third driver 123 may receive the comparison voltage signal VCOM to drive the node ND12 to the ground voltage VSS. The second drivability may be greater than the first drivability. More specifically, the comparator 12 may generate the comparison signal COM having a logic "high" level because the second drivability is greater than the first drivability.

The voltage divider 131 may divide the power supply voltage VDD to generate the first to fourth division voltage signals DIV1~DIV4. The counter 132 may receive the comparison signal COM having a logic "high" level to not count the first and second count signals CNT<1:2>. The selection transmitter 133 may receive the first count signal CNT<1> with a logic "high" level and the second count signal <2> with a logic "low" level to output the second division voltage signal DIV2. The second division voltage signal DIV2 may be outputted as the comparison voltage signal VCOM.

The voltage supply circuit 20 may receive the comparison signal COM having a logic "high" level to output the comparison voltage signal VCOM as the internal voltage signal VINT.

The internal circuit 30 may be driven by the internal voltage signal VINT whose level is boosted. More specifically, the transistors that constitute the internal circuit 30 may be driven by the internal voltage signal VINT. The level of the internal voltage signal VINT is controlled according to temperature variation.

As described above, the semiconductor device according to an embodiment may control a level of the internal voltage signal VINT according to temperature variation to supply the controlled internal voltage signal VINT to the internal circuit 30. In particular, the semiconductor device may compensate for variation of the drivability of the transistors according to temperature variation to prevent malfunction thereof.

Figure 5:
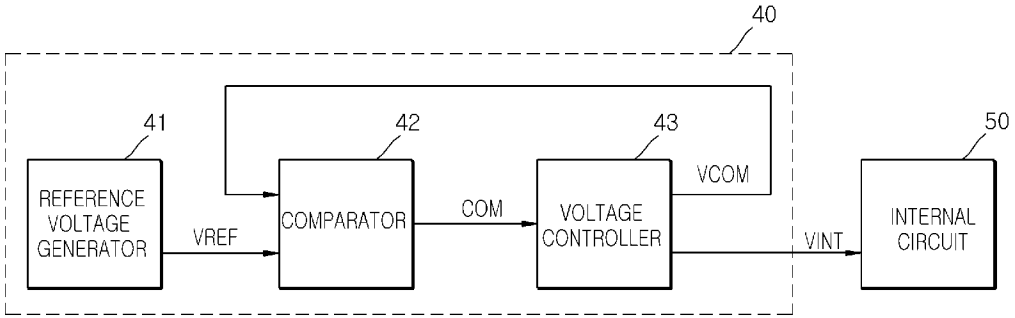
FIG. 5 is a block diagram illustrating a semiconductor device according to an embodiment of the invention.

Referring to FIG. 5, a semiconductor device according to an embodiment may include a voltage generation circuit 40 and an internal circuit 50.

The voltage generation circuit 40 may include a reference voltage generator 41, a comparator 42 and a voltage controller 43.

The reference voltage generator 41 may generate a reference voltage signal VREF having a constant level regardless of temperature variation. The reference voltage generator 41 may be realized to have substantially the same configuration as the reference voltage generator 11 described with reference to FIG. 1. Accordingly, the detailed description of the reference voltage generator 41 will be omitted hereinafter.

The comparator 42 may compare a first drivability controlled according to a level of the reference voltage signal VREF with a second drivability controlled according to a level of a comparison voltage signal VCOM. The first drivability may be compared to the second drivability to generate a comparison signal COM enabled when the second drivability is greater than the first drivability. The comparator 42 may have substantially the same configuration as the comparator 12 described with reference to FIG. 2. Therefore, the detailed description of the comparator 42 will be omitted hereinafter.

The voltage controller 43 may generate the comparison voltage signal VCOM whose level continuously increases until the comparison signal COM is enabled. The voltage controller 43 may output the comparison voltage signal VCOM as an internal voltage signal VINT if the comparison signal COM is enabled. The voltage controller 43 may be realized to have substantially the same configuration as the voltage controller 13 described with reference to FIG. 3. Thus, the detailed description of the voltage controller 43 will be omitted hereinafter.

The internal circuit 50 may be driven by the internal voltage signal VINT.

Figure 6:
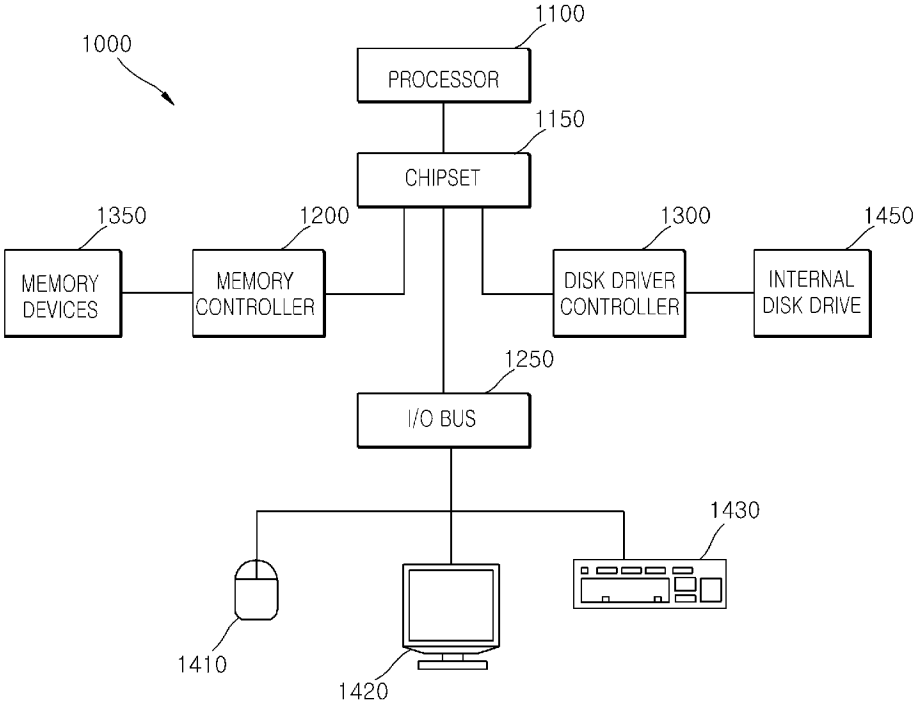
FIG. 6 illustrates a block diagram of a system employing a memory controller circuit in accordance with an embodiment of the invention.

Referring to FIG. 6, a system 1000 may include one or more processors 1100. The processor 1100 may be used individually or in combination with other processors. A chipset 1150 may be electrically coupled to the processor 1100. The chipset 1150 is a communication pathway for signals between the processor 1100 and other components of the system 1000. Other components of the system 1000 may include a memory controller 1200, an input/output ("I/O") bus 1250, and a disk drive controller 1300. Depending on the configuration of the system 1000, any one of a number of different signals may be transmitted through the chipset 1150.

The memory controller 1200 may be electrically coupled to the chipset 1150. The memory controller 1200 can receive a request provided from the processor 1100 through the chipset 1150. The memory controller 1200 may be electrically coupled to one or more memory devices 1350. The memory device 1350 may include the semiconductor device described above.

The chipset 1150 may also be electrically coupled to the I/O bus 1250. The I/O bus 1250 may serve as a communication pathway for signals from the chipset 1150 to I/O devices 1410, 1420 and 1430. The I/O devices 1410, 1420 and 1430 may include a mouse 1410, a video display 1420, or a keyboard 1430. The I/O bus 1250 may employ any one of a number of communications protocols to communicate with the I/O devices 1410, 1420 and 1430.

The disk drive controller 1300 may also be electrically coupled to the chipset 1150. The disk drive controller 1300 may serve as the communication pathway between the chipset 1150 and one or more internal disk drives 1450. The disk drive controller 1300 and the internal disk drive 1450 may communicate with each other or with the chipset 1150 using virtually any type of communication protocol.

The semiconductor device according to an embodiment may control a level of the internal voltage signal VINT according to temperature variation to supply the controlled internal voltage signal VINT to the internal circuit 50. More specifically, the semiconductor device according to embodiments may compensate for variation of the drivability of the transistors constituting the internal circuit 50 according to temperature variation to prevent malfunction thereof.

What is claimed is:

1. A voltage generation circuit comprising:

a reference voltage generator suitable for generating a reference voltage signal having a constant level without a correspondence to a temperature variation;

a comparator suitable for comparing a first drivability controlled by a level of the reference voltage signal with a second drivability controlled by a level of a comparison voltage signal to generate a comparison signal;

a voltage divider suitable for dividing a power supply voltage to generate first to fourth division voltage signals whose levels are divided by a plurality of resistors serially connected between a power supply voltage terminal and a ground voltage terminal;

a counter suitable for outputting first and second count signals counted in response to an external clock if the comparison signal is disabled; and a selection transmitter suitable for outputting any one of the first to fourth division voltage signals as the comparison voltage signal according to a level combination of the first and second count signals.

2. The voltage generation circuit of claim 1, wherein a level of the comparison voltage signal varies according to temperature variation.

3. The voltage generation circuit of claim 1, wherein the comparison signal is enabled when the second drivability is greater than the first drivability.

4. The voltage generation circuit of claim 1, wherein the comparator includes:

a first driver suitable for being electrically coupled between a power supply voltage terminal and first and second nodes to drive the first node and the second node to have a power supply voltage, wherein the comparison signal is outputted through the first node according to a level of the second node;

a second driver suitable for being electrically coupled between the first node and a ground voltage terminal to drive the first node to have a ground voltage with the first drivability according to a level of the reference voltage signal; and a third driver suitable for being electrically coupled between the second node and the ground voltage terminal to drive the second node to have the ground voltage with the second drivability according to a level of the comparison voltage signal.

5. The voltage generation circuit of claim 4, wherein the second driver includes a first drive element that drives the first node with the first drivability according to the level of the reference voltage signal.

6. The voltage generation circuit of claim 5, wherein the third driver includes a second drive element that drives the second node with the second drivability according to the level of comparison voltage signal; and wherein the second drive element has a drivability which is less than a drivability of the first drive element.

7. A semiconductor device comprising:

a voltage generation circuit suitable for comparing a first drivability controlled by a reference voltage signal with a second drivability controlled by a comparison voltage signal to generate a comparison signal, wherein a level of the comparison voltage signal increases until the comparison signal is enabled;

wherein the voltage generation circuit includes:

a reference voltage generator suitable for generating the reference voltage signal having a constant level without a correspondence to a temperature variation;

a comparator suitable for generating the comparison signal enabled when the second drivability is greater than the first drivability;

a voltage divider suitable for dividing a power supply voltage to generate first to fourth division voltage signals whose levels are divided by a plurality of resistors serially connected between a power supply voltage terminal and a ground voltage terminal;

a counter suitable for outputting first and second count signals counted in response to an external clock when the comparison signal is disabled;

a selection transmitter suitable for outputting any one of the first to fourth division voltage signals as the comparison voltage signal according to a level combination of the first and second count signals;

a voltage supply circuit suitable for outputting the comparison voltage signal as an internal voltage signal when the comparison signal is enabled; and an internal circuit suitable for being driven by the internal voltage signal.

8. The semiconductor device of claim 7, wherein a level of the comparison voltage signal varies according to temperature variation.

9. The semiconductor device of claim 7, wherein the comparator includes:

a first driver suitable for being electrically coupled between a power supply voltage terminal and first and second nodes to drive the first node according to a level of the second node, wherein the comparison signal is outputted through the first node according to the level of the second node;

a second driver suitable for being electrically coupled between the first node and a ground voltage terminal to drive the first node with the first drivability according to a level of the reference voltage signal; and a third driver suitable for being coupled between the second node and the ground voltage terminal to drive the second node with the second drivability to have a ground voltage according to a level of the comparison voltage signal.

10. The semiconductor device of claim 9, wherein the second driver includes a first drive element that drives the first node with the first drivability according to the level of the reference voltage signal.

11. The voltage generation circuit of claim 10, wherein the third driver includes a second drive element that drives the second node with the second drivability according to a level of the comparison voltage signal; and wherein the second drive element has a drivability less than a drivability of the first drive element.

* * * * *